US005286158A

United States Patent [19]

Zimmerman

[11] Patent Number: 5,286,158

[45] Date of Patent: Feb. 15, 1994

[54] MATERIAL DISTRIBUTING APPARATUS

[76] Inventor: Harold M. Zimmerman, R.D. #1, Wabash Rd., Ephrata, Pa. 17522

[21] Appl. No.: 901,132

[22] Filed: Jun. 19, 1992

[51] Int. Cl.[5] ..... B44D 1/08

[52] U.S. Cl. ..... 414/504; 239/650; 414/523; 414/489; 414/528; 198/640; 198/818; 198/317; 198/318

[58] Field of Search ..... 414/528, 196, 502, 503, 414/504, 505, 489, 523; 198/640, 641, 818, 317, 318, 315, 316; 239/663, 664, 668, 670, 672, 676, 689, 650

[56] References Cited

U.S. PATENT DOCUMENTS

| | | | |
|---|---|---|---|
| 1,448,835 | 3/1923 | Egger | 414/489 |
| 1,515,329 | 11/1924 | Barkmann et al. | 414/489 |
| 1,924,825 | 8/1933 | Young | 239/672 |
| 2,284,853 | 6/1942 | Wall | 414/523 X |
| 2,422,268 | 6/1947 | Symonds | 414/393 |
| 2,464,217 | 3/1949 | Dillingham | 414/523 |
| 2,484,689 | 10/1949 | Davis | 414/489 |
| 2,605,913 | 8/1952 | Hon | 414/353 |
| 2,609,115 | 9/1952 | Oklejas | 414/504 |
| 2,670,839 | 3/1954 | Aasland | 198/640 |
| 3,018,908 | 1/1962 | Wilton et al. | 414/489 |
| 3,760,933 | 9/1973 | Maldeis et al. | 239/650 |
| 3,863,783 | 2/1975 | Spellman, Jr. | 414/523 |
| 4,781,513 | 11/1988 | Ajogren et al. | 414/489 |
| 4,790,715 | 12/1988 | Alexander | 414/528 |
| 5,044,867 | 9/1991 | Pettijohn | 414/523 |

FOREIGN PATENT DOCUMENTS

| | | | |
|---|---|---|---|
| 1143329 | 3/1985 | U.S.S.R. | 198/640 |
| 2167369 | 5/1986 | United Kingdom | 198/818 |

*Primary Examiner*—Frank E. Werner
*Attorney, Agent, or Firm*—Larry W. Miller

[57] ABSTRACT

An apparatus for mounting on the back of a dump truck or the like to distribute material discharged from said truck to a variably selected position is disclosed wherein a chute assembly is connectable to the tailgate of the dump truck and provides a range of movement of the apparatus in a vertical direction through pivotal movement about a horizontal axis and a range of movement of the apparatus in a horizontal direction through a swing ring. The apparatus incorporates an endless conveyor having a downwardly deflected portion to receive material from the chute assembly and convey the material to a discharge opening for projection to a selected location. A constraining member restricts the material to the central portion of the conveyor to minimize the spreading of the material being discharged from the conveyor. A deflector panel positioned at the discharge opening of the apparatus to engage the stream of material being discharged provides greater flexibility for the direction of the material to a desired location.

19 Claims, 4 Drawing Sheets

MATERIAL DISTRIBUTING APPARATUS

BACKGROUND OF THE INVENTION

This invention relates generally to material distributing mechanisms and, more particularly, to a conveyor attachment mountable to the back of a dump truck to receive material such as stone therefrom and project the material to a desired location remote from the truck.

It has been found desirable to deposit flowable material, such as stone or sand, at a location remote from the location from which a truck bearing such material can reach. For example, a truck carrying stone to be spread around the floor base of a foundation prior to having concrete poured for the floor may only be able to reach one location close to the foundation, whereas the stone must be uniformly spread throughout the foundation base. Rather than carry the stone throughout the foundation to be spread manually, it would be desirable to have an apparatus to receive the stone from the truck and distribute the stone throughout the foundation from the single point of discharge from the truck.

Conveying mechanisms have been developed to accomplish this desired task, such as can be seen in U.S. Pat. No. 5,044,867, issued to M. J. Pettijohn on Sep. 3, 1991. This particularly conveying device suffers from the problem of being too large and bulky. Even though the Pettijohn conveying mechanism collapses into a transport position, the mechanism commands a significant amount of room behind the vehicle and adds a significant amount of weight to the rear of the truck. Furthermore, the Pettijohn apparatus is limited in flexibility in usage because of the support required for the end of the conveyor and the large amount of room required for utilization. For example, depositing materials close to the truck would be difficult.

Other dispensing mechanisms are known in the art, such as the conveyor disclosed in U.S. Pat. No. 3,018,908, issued to H. C. Wilton on Jan. 30, 1962. It is noted that such conveying mechanisms are generally used to discharge material laterally of the truck, although other unloading mechanisms, such as the conveyor disclosed in U.S. Pat. No. 1,448,835, issued to A. W. Egger on Mar. 20, 1923, are intended to be used to deposit material either rearwardly or laterally of the vehicle.

Each of these known unloading or conveying mechanisms are rather large and bulky in nature and have a limited range of use. Most of these mechanisms use a belt conveyor which has a maximum speed of operation due to the tendency of the belt to slip from underneath the material being conveyed thereon, thereby limiting the range at which the material can be discharged from the apparatus. While the contact on the material with the conveyor belt can be improved by extending the length of the conveyor belt, as is taught in the aforementioned prior art references, any lengthening of the apparatus results in a direct loss of flexibility in use and compactness for transport.

It would, therefore, be desirable to provide a material distributing mechanism cooperable with a mobile vehicle that would be sufficiently compact to permit an unobtrusive positioning for an inoperative transport, while providing an apparatus that has great flexibility in use to deposit material dispensed from the vehicle along a large range of locations.

SUMMARY OF THE INVENTION

It is an object of this invention to overcome the aforementioned disadvantages of the prior art by providing a compact conveying mechanism mountable to the tailgate of a dump truck.

It is another object of this invention to provide a material distributing mechanism that has an arcuate depression against which centrifugal force and gravity help retain the material against the conveyor belt to permit an increase in discharge velocity.

It is still another object of this invention to provide a material distributing mechanism that can be compactly positioned in an inoperative transport position.

It is yet another object of this invention to provide a material distributing mechanism that is both pivotally movable about a horizontal pivot axis and rotatable about a generally vertically extending axis of rotation to provide a large range of distribution of material therefrom.

It is a feature of this invention that the conveyor belt has an operative run with an arcuate depression therein through which material must pass before being discharged.

It is an advantage of this invention that centrifugal force pulls the material toward the conveyor belt as the material moves from the chute assembly to the discharge end of the conduit.

It is another feature of this invention that the chute assembly is articulated to incorporate a horizontal pivot axis and provide a vertical range of movement for the apparatus.

It is still another feature of this invention that the chute assembly incorporates a swing ring to which the conduit and the conveyor are mounted for rotation about a vertical axis of rotation to provide a horizontal range of movement for the apparatus.

It is another advantage of this invention that the material distributing mechanism has approximately a 180 degree range of horizontal notion at variable elevations to direct the flow of material from the conveyor.

It is another advantage of this invention that the material being discharged from the conveyor can be directed into a great variety of locations remote from the vehicle to which the material distributing apparatus is mounted.

It is yet another feature of this invention that the chute assembly funnels material into a downwardly moving portion of the operative run of the conveyor belt to feed material onto a central portion of the conveyor belt.

It is still another advantage of this invention that the chute mechanism meters the amount of material being fed onto the conveyor.

It is still another advantage of this invention that the material fed onto the conveyor belt must pass through the downwardly depressed portion of the operative run of the conveyor belt before being discharged from the conduit.

It is yet another feature of this invention that the conduit is provided with a constraining member positioned above the operative run of the conveyor to deflect material to be distributed back onto the central portion of the conveyor belt.

It is yet another advantage of this invention that the material is retained on the central portion of the belt by the constraining member.

It is a further advantage of this invention that the stream of material being discharged from the conduit is retained in a relatively tight flow path with minimal dispersal.

It is still a further advantage of this invention that the material being discharged from the conduit can be accurately placed at the desired location remotely from the mechanism.

It is still another feature of this invention that a deflection panel is provided adjacent the discharge opening of the conduit to be pivotally movable into engagement with the stream of material being discharged off the conveyor.

It is still a further advantage of this invention that the deflector panel can be utilized to deflect material to a location very close to the material distributing mechanism and to the vehicle to which the mechanism is mounted.

It is a further feature of this invention the drive mechanism operatively powering the rotation of the conveyor belt can be operated at variable speeds to vary the velocity of the discharge of material from the conveyor belt.

It is yet a further advantage of this invention that the velocity at which the material is discharged from the conduit can be combined with the selected orientation of the conduit to provide greater flexibility and accuracy of delivery of the material to the desired location.

It is yet a further feature of this invention that the chute assembly can be detachably connected to the tailgate of a dump truck for full support of the material distributing mechanism therefrom.

It is yet a further advantage of this invention that the velocity at which the conveyor belt can be driven can be maximized because of the utilization of centrifugal force to urge the material in contact with the conveyor belt, thereby permitting the material to be discharged to a remote location even though a relatively short conveyor belt is used.

It is a further object of this invention to provide a material distributing mechanism that is durable in construction, inexpensive of manufacture, carefree of maintenance, facile in assemblage, and simple and effective in use.

These and other objects, features and advantages are accomplished according to the instant invention by providing an apparatus for mounting on the back of a dump truck or the like to distribute material discharged from said truck to a variably selected position wherein a chute assembly is connectable to the tailgate of the dump truck and provides a range of movement of the apparatus in a vertical direction through pivotal movement about a horizontal axis and a range of movement of the apparatus in a horizontal direction through a swing ring. The apparatus incorporates an endless conveyor having a downwardly deflected portion to receive material from the chute assembly and convey the material to a discharge opening for projection to a selected location. A constraining member restricts the material to the central portion of the conveyor to minimize the spreading of the material being discharged from the conveyor. A deflector panel positioned at the discharge opening of the apparatus to engage the stream of material being discharged provides greater flexibility for the direction of the material to a desired location.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
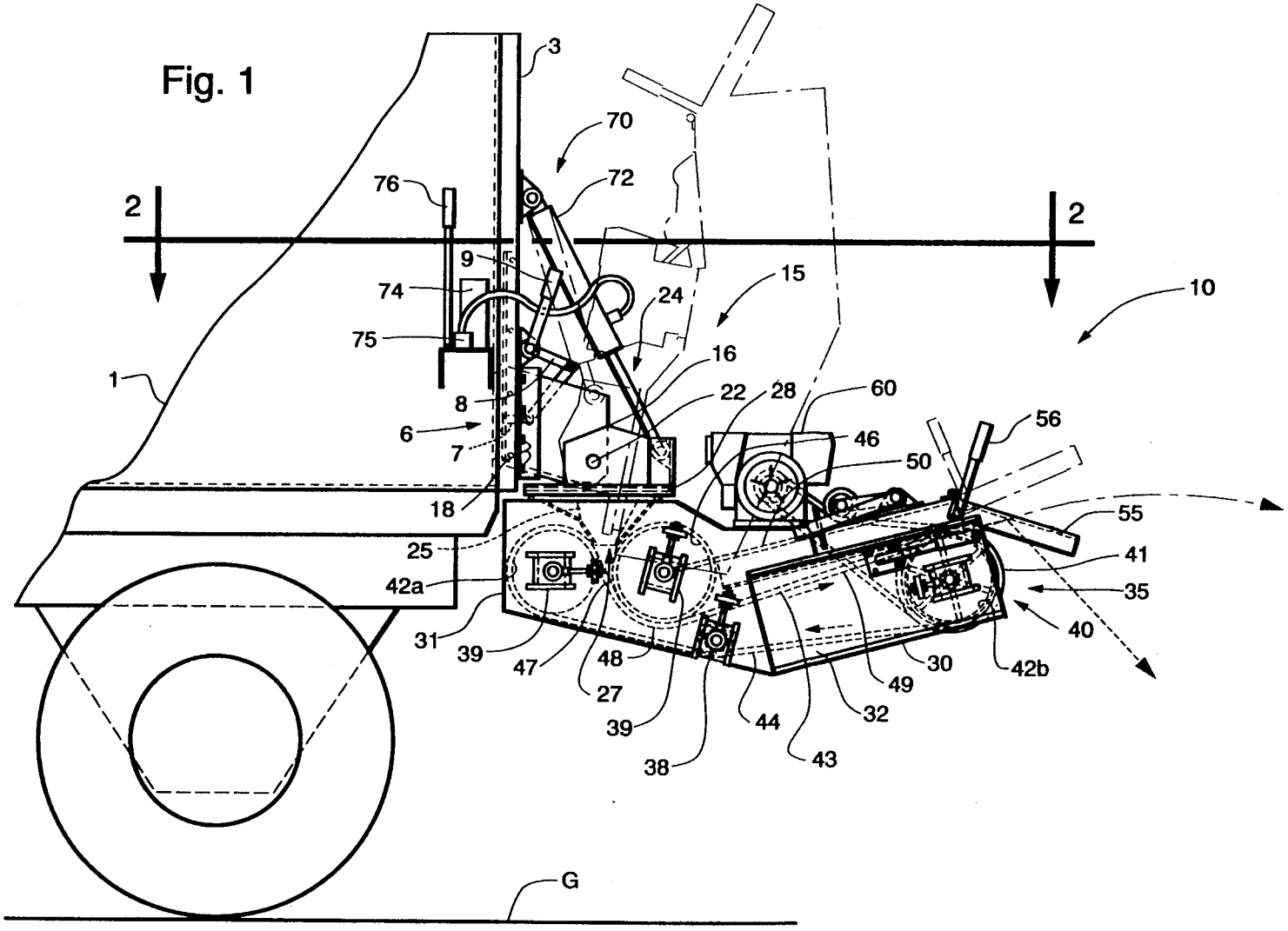
FIG. 1 is a left side elevational view of the material distributing mechanism incorporating the principles of the instant invention, the material distributing mechanism being mounted to the tailgate of a representative dump truck schematically shown and broken away for purposes of clarity, the vertical movement of the conduit being shown in phantom, as is the pivotal movement of the deflector panel.
Figure 2:
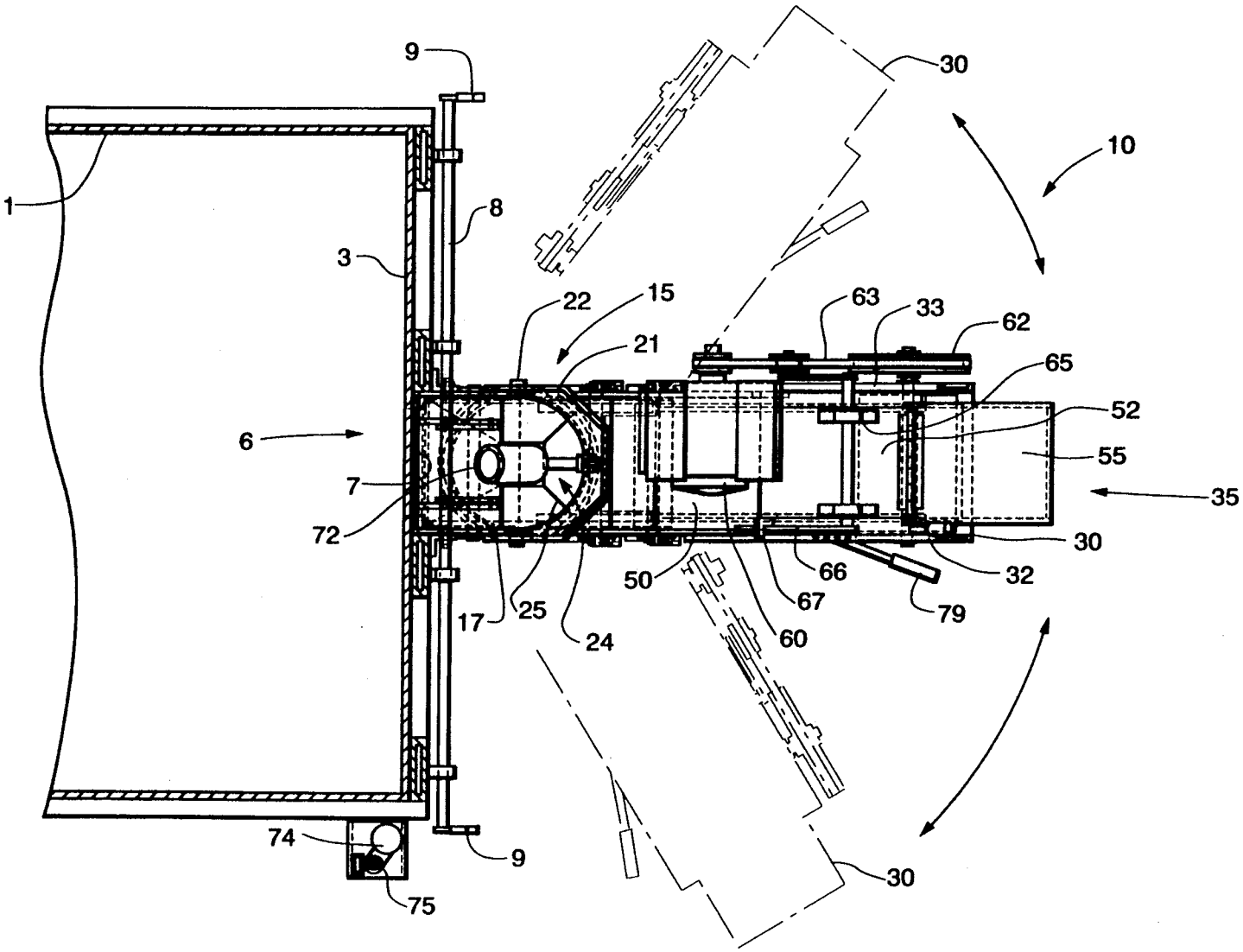
FIG. 2 is a partial cross-sectional view of the mechanism taken along lines 2—2 of FIG. 1 to depict generally a top plan view of the mechanism, the horizontal movement of the conduit being shown in phantom, the representative vehicle being broken away for purposes of clarity.

Referring now to all the Figs., the material distributing mechanism incorporating the principles of the instant invention can best be seen. Any left and right references are used as a matter of convenience and are determined by standing at the rear of the conduit adjacent the discharge opening thereof and facing the vehicle to which the mechanism is mounted. The material distributing mechanism 10, hereinafter referred to as a slinger 10, is depicted as being mounted to the tailgate 3 of a representative dump truck 1 to receive material from the truck 1 through a discharge opening 6 having a slidable gate 7 metering the flow of material therefrom. The movement of the gate 7 being controlled by an actuating linkage 8 manually operated through manipulation of a handle 9.

The slinger 10 includes a chute assembly 15 having an articulated material receiving portion 16 including a first member 17 detachably connected to the tailgate 3 by bolts 18 to be positioned in flow communication with the discharge opening 6 to receive material therefrom. The material receiving portion 16 of the chute assembly 15 also includes a second member 21 pivotally connected to the first member 17 for pivotal movement relative to the first member 17 about a generally horizontally extending pivot axis 22. The material receiving portion 16 defines an inlet opening 24 for the passage of material into the chute assembly 15.

The chute assembly 15 also has a feed portion 25 extending below the second member 21 in flow communication therewith. The feed portion terminates in an outlet opening 27 that is smaller than the inlet opening 24 to meter the flow of material through the chute assembly 15, the feed portion 25 serving as a funnel to direct material through the outlet opening 27. The chute assembly 15 is provided with a swing ring 28 interposed between and connected to both the second member 21 and the feed portion 25 to permit rotational movement of the feed portion 25 relative to the material receiving portion 16 about a generally vertically extending axis of rotation perpendicular to the plane of the swing ring 28.

An elongated conduit 30 is mounted at the forward end 31 to the swing ring 28 so as to be rotatable with the feed portion 25 relative to the material receiving portion 16. The conduit 30 is formed of a pair of laterally spaced side sheets 32, 33 extending rearwardly from the forward end 31 to terminate at a rearward end 34 defining a discharge opening 35. A floor member 36 provides structural integrity for the conduit and maintains the side sheets 32, 33 in a generally parallel orientation.

An endless conveyor 40 is housed within the conduit 30. The conveyor 40 includes an endless conveyor belt 41 entrained around a first roller **42*a* rotatably mounted between the side sheets 32, 33 at the forward end 31 of the conduit 30 and a second roller 42*b* rotatably mounted between the side sheets 32, 33 at the rearward end 34 adjacent the discharge opening 35. Each roller 42*a*, 42*b* is associated with a conventional positional adjustment apparatus 39 to effect a movement of the respective roller 42*a*, 42*b* relative to the other roller 42*a*, 42*b* to tighten the conveyor belt 41 therebetween for a proper driving relationship. The conveyor belt 41 is divided into an operative run 43, which during normal operation moves from the first roller 42*a* to the second roller 42*b* to convey material thereon toward the discharge opening 35, and a return run 44 in which the belt 41 moves from the second roller 42*b* toward the first roller 42*a***.

A deflection device 45 is rotatably mounted between the side sheets 32, 33 in engagement with the conveyor belt 41. The deflection device 45 is formed of a pair of laterally spaced discs 46 positioned adjacent the respective side sheets 32, 33. A shaft **46*a* preferably extends between the two discs 46 to better maintain the proper spacing therebetween. The discs 46 engage the lateral edges of the conveyor belt 41 and forces the path of the belt 41 to pass underneath the discs 46 to create a downward depression as compared to a straight line passing between the two rollers 42*a*, 42*b*. As a result the operative run 43 of the conveyor belt 41 is divided into a downwardly moving portion 47 extending between the first roller 42*a* and the discs 46, an upwardly moving portion 49 extending between the discs 46 and the second roller 42*b*, and an arcuate transition portion 48 extending between the downwardly moving portion 47 and the upwardly moving portion 49 as the belt 41 passes underneath the discs 46**.

The conveyor 40 and the discs 46 are situated such that the feed portion 25 is positioned immediately above the downwardly moving portion 47 so that material can pass through the outlet opening 27 directly onto either the downwardly moving portion 47 or the arcuate transition portion 48 of the belt 41. Because of the amount of downward deflection of the operative run 43 caused by the discs 46, it is necessary to deflect the return run 44 to prevent interference with the operative run 43. To this purpose, an idler roller 38 is rotatably supported between the side sheets 32, 33 to engage and deflect the return run 44 downwardly. Like the rollers **42*a*, 42*b*, the idler roller 38 and the discs 46 are each provided with a conventional positional adjustment apparatus 39** to effect a adjustable movement to accommodate wear and positional misalignments.

The conduit 30 is provided with a constraining member 50 supported by the side sheets 32, 33 above the upwardly moving portion 49 of the conveyor belt 41. The constraining member has a raised bight portion 52 extending between a pair of laterally spaced legs 54. While the drawings depict the legs 54 as being generally horizontally oriented, one skilled in the art will readily understand that the legs 54 could be angled from the raised bight portion 52 to the respective side sheets 32, 33. One skilled in the art will readily realize that the movement of the material on the belt 41 from the arcuate transition 48 to the upwardly moving portion 49 will result in a tendency for material particles to release from the top of the pile of material on the belt 41. The purpose of the constraining member 50 is to deflect material prematurely leaving the belt 41 back onto the central part of the upwardly moving portion 49. The raised bight portion 52 extends forwardly to the shaft **46*a* between the discs 46 to a position immediately above the arcuate transition portion 48 and terminates rearwardly at the discharge opening 35. The laterally spaced legs 54 cannot extend as far forwardly as the bight portion 52 because of interference with the discs 46**.

A deflector panel 55 is pivotally connected to the constraining member 50 adjacent the discharge opening 35. The deflector panel 55 is pivotally movable through manipulation of the attached handle 56 between a lowered position as shown in solid in FIG. 1 and a raised position shown in phantom in FIG. 1. The deflector panel 55 when in the lowered position is operable to intercept and deflect the stream of material being discharged from the conveyor belt 41 through the discharge opening 35 directly toward the ground G. By pivotally manipulating the position of the deflector panel 55, the direction of the flow of the discharged stream of material can be selectively varied. Completely pivoting the deflector panel 55 to the raised position prevents the panel 55 from engaging the stream of material.

Figure 3:
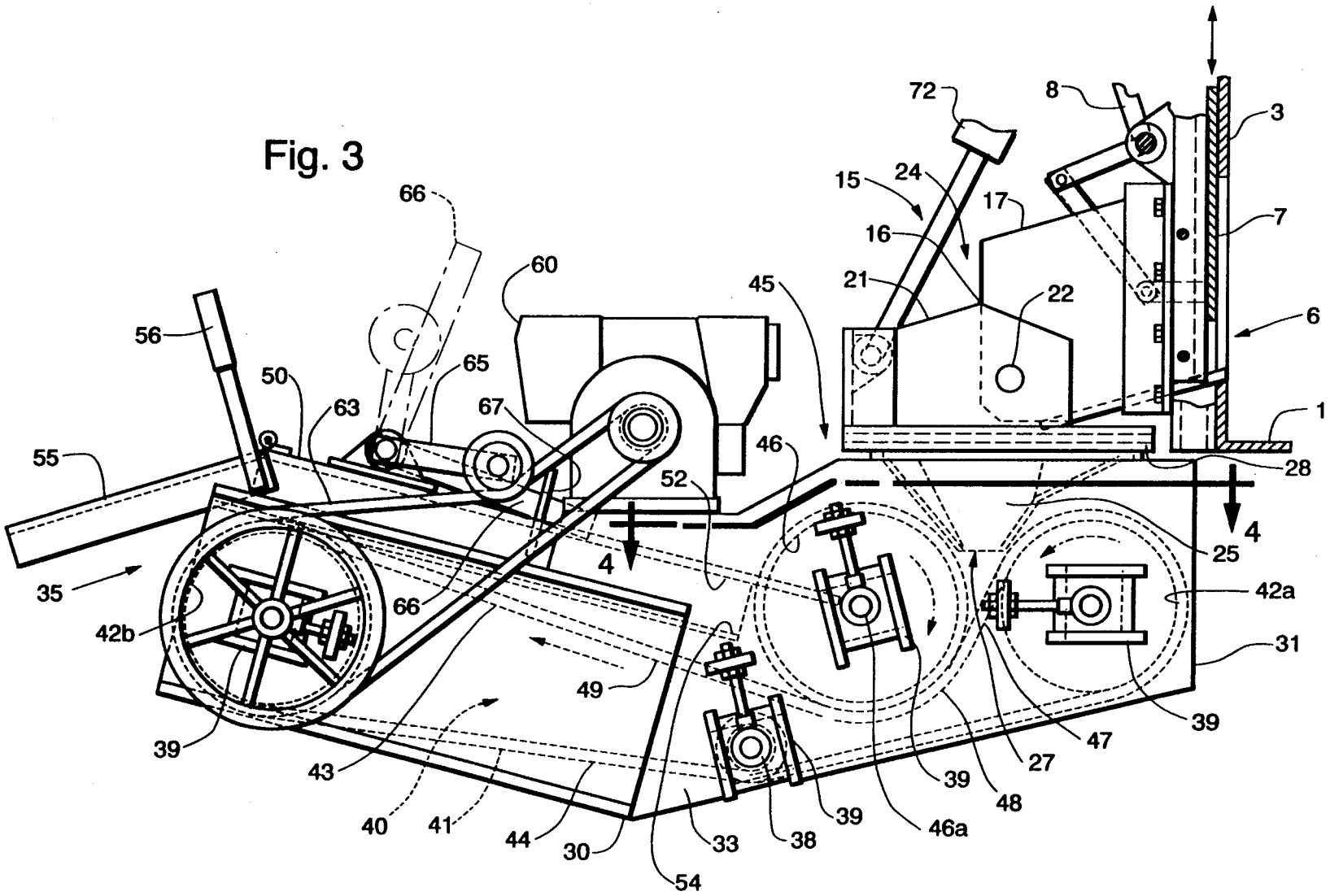
FIG. 3 is an enlarged right side elevational view of the material distributing mechanism shown in FIGS. 1 and 2, only a portion of the tailgate of the representative vehicle to which the mechanism is mounted is depicted, the movement of the idler sprocket for engaging the drive mechanism for powering the rotation of the conveyor being shown in phantom.
Figure 4:
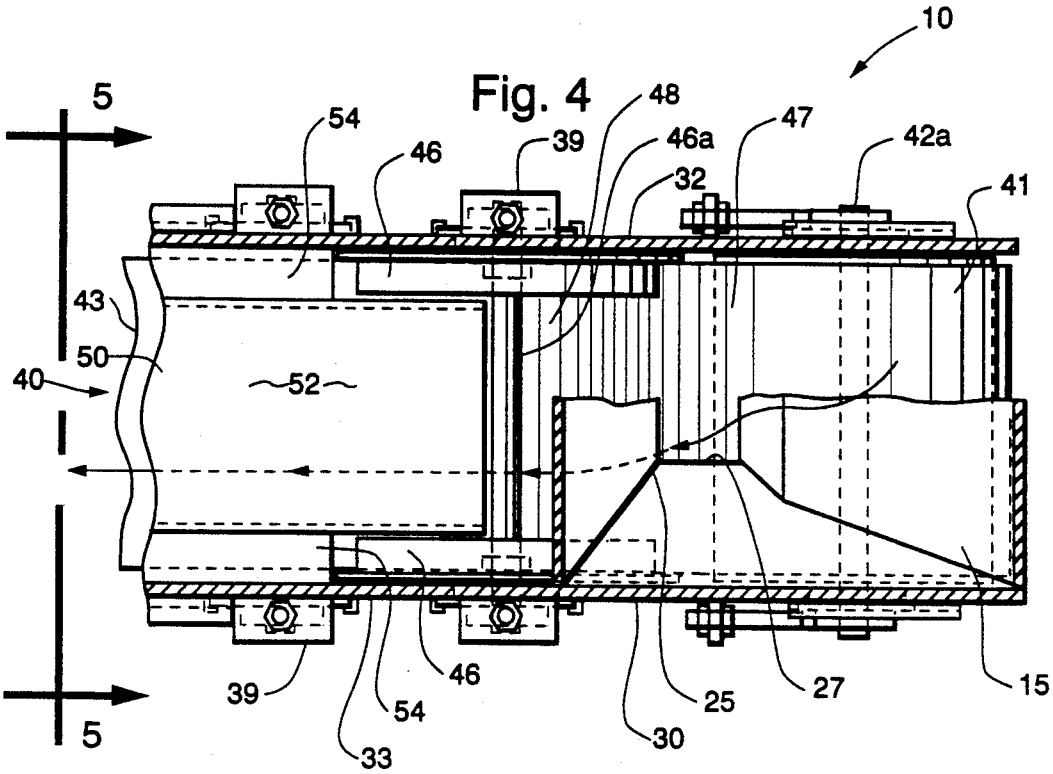
FIG. 4 is a partial cross-sectional view of the material distributing mechanism taken along lines 4–4 of FIG. 3, portions of the chute assembly being broken away for purposes of clarity.
Figure 5:
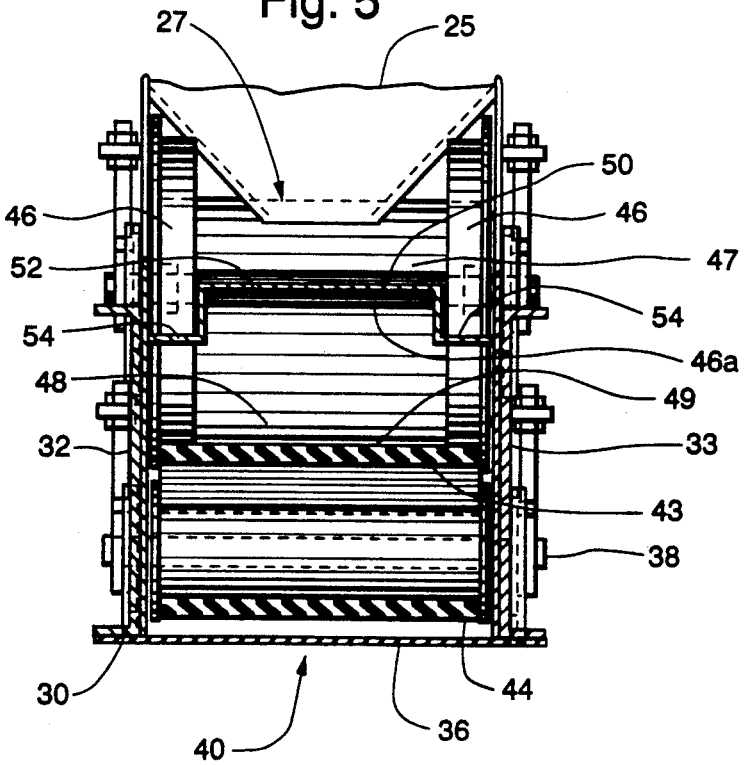
FIG. 5 is a cross-sectional view of the material distributing mechanism taken along lines 5—5 of FIG. 4 to depict generally a rear view of the mechanism looking in the discharge opening.

The primary operative power is provided by an engine 60 supported on the conduit 30. The engine 60 is operatively associated with a belt drive mechanism 62 to transfer operative power to the second roller **42*b* to drive the rotation thereof. As a result of frictional engagement between the other rotatable components, such as the belt 41, the first roller 42*a* and the discs 46, and the second roller 42*b*, the conveyor 40 is rotatably operable to convey material from the chute assembly 15 to the discharge opening 35. The belt drive mechanism 62 is provided with a pivotable idler assembly 65, as best depicted in FIG. 3, that is selectively movable into engagement with the belt 63 to effect tension therein and permit the transmission of operative power from the engine 60 to the second roller 42*b*. As best shown in FIG. 1, the idler assembly 65 includes a handle 66 for manually moving the idler assembly 65 into engagement with the belt 63 and a locking bracket 67 fixed on the left side sheet 32 for engagement with the handle 66 to maintain the idler assembly 65 in engagement with the belt 63** for the continuous transmission of rotational power.

The chute assembly 15 is also provided with a lift mechanism 70 using a hydraulic cylinder 72 as a linear actuator interconnecting the second member 21 and preferably the tailgate 3 of the vehicle 1 to effect pivotal movement of the slinger 10 about the pivot axis 22 between a raised transport position shown in phantom in FIG. 1 and a lowered operative position shown in solid lines in FIG. 1. The vertical movement of the slinger 10 can be used to aim the direction of the discharge flow of material from the conduit discharge opening 35. The hydraulic cylinder 72 is provided with a manually operated pump 75 mounted in a conveniently accessible location for the operator, such as at the side of the vehicle V, as shown in FIG. 1 or perhaps of the tailgate T. Actuation of the pump handle 76 forces hydraulic fluid from a reservoir 74 into the hydraulic cylinder 72 to effect a raising of the conduit 30. A release of the hydraulic pressure through manipulation of a convention valve (not shown) will allow gravity to lower the conduit and return the hydraulic fluid to the reservoir 74.

One skilled in the art will realize that the slinger 10 can be relatively easily mounted to or disconnected from the tailgate 3 of the truck vehicle 1 by manipulation of a plurality of bolts 18 engaged with the first member 17 to fix the chute assembly 15 to the tailgate 3 to receive material carried by the vehicle 1 and discharged through the gated discharge opening 6 and by connecting the hydraulic cylinder 72. Movement of the slinger 10 to a compact transport position against the tailgate 3 can be easily accomplished by fulling raising the conduit 30 to the raised position shown in phantom in FIG. 1 and by rotating the conduit 30 about the swing ring 28 until the conduit 30 is rotated sideways against the tailgate T. In this transport position, the slinger 10 does not project outwardly beyond the sides of the vehicle V.

Once mounted, the slinger 10 is operated by the starting of the engine 60 and manipulation of the idler assembly 65 to engage the belt 63 and permit the transmission of rotational power to the second roller **42*b* and the conveyor 40. An opening of the slidable gate 7 by manipulation of the actuation linkage 8 will cause a flow of material from the vehicle 1 into the chute assembly 15, which in turn funnels the material into the feed portion 25 and meters the material through the outlet opening 27 onto the conveyor belt 41. Since the material must pass through the arcuate transition portion 48 of the belt 41 to reach the upwardly moving portion 49, and ultimately the discharge opening 35, the material travels along a circular arc corresponding to the arcuate transition portion 48 and is forced against the belt 41** by both gravity and centrifugal force.

As a result, the belt 41 can be operated at a greater speed without sliding beneath the material. By the time the material reaches the upwardly moving portion 49, the material and belt 41 are generally moving at equal velocities and heading toward the discharge opening 35. It should be noted that some of the material, particularly the material most distantly spaced above the belt 41, may be propelled upwardly, when exiting the arcuate transition portion 48 and entering the upwardly moving portion 49, and impacted against the constraining member 50, which directs the material back onto the central part of the upwardly moving portion of the belt 41.

The flow of the material exits the belt 41 when it passes over the second roller **42*b* and momentum gathered by the movement of the material along the conveyor belt 41 carries the material in a stream outwardly from the conduit 30 through the discharge opening 35. By selectively manipulating the hydraulic cylinder 72 to vary the elevation along with the stream of material is discharged and by horizontally swinging the conduit 30 about the swing ring 28, preferably by pushing or pulling on the handle 79 fixed to the left side sheet 32**, to vary the direction along which the material is discharged, the operator can selectively place the material along a wide range of locations rearwardly of the vehicle V.

The operator can also vary the speed at which the conveyor 40 is rotated by manipulating the speed at which the engine 60 is operating and, thereby, selectively vary the amount of momentum imparted to the material conveyed on the belt 41 and vary correspondingly the distance from the conduit the material is propelled. Preferably, however, the operator will operate the conveyor 40 at the maximum speed possible without losing contact with the material as it progresses along the upwardly moving portion 49 so that the volume of material passing through the chute assembly can be maximized. Obviously, less material can be fed through the chute assembly 15 and onto the conveyor 40 if the conveyor 40 is operated slower than such maximum speed.

The distance from the conduit at which the stream of material is deposited on the ground can be varied more efficiently by utilizing the deflector panel 55 to intercept the stream of material exiting the discharge opening 35. Accordingly, the material carried by the vehicle 1 can be distributed to the ground G at any desired location in a uniform manner by the operator manipulating the movement of the conduit about the pivot axis 22 and about the swing ring 28 and by manipulating the pivoted position of the deflector panel 55. The utilization of the arcuate depression formed in the operative run 43 by the discs 46 enables the material to be carried by the belt 41 with an equal velocity therewith in a shorter distance and, thereby requiring a shorter operative run 43 and a more compact slinger 10.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. A material distributing mechanism comprising:

a frame generally defining a conduit having a discharge opening;

a pair of rollers rotatably mounted in said frame at opposing ends of said conduit with one of said rollers being mounted proximate to said discharge opening;

an endless conveyor entrained around said rollers for rotational movement therewith, said conveyor having an upper operative run which normally moves toward said discharge opening and a lower return run normally moving away from said discharge opening;

deflection means operatively engaged with the operative run of said conveyor between said rollers to cause a downward deflection of said conveyor, said operative run being divided into a downwardly moving portion, an upwardly moving portion and a generally arcuate transition portion between said downwardly moving portion and said upwardly moving portion;

chute means for receiving material and directing the material onto the downwardly moving portion of said operative run, said frame being connectable to a supply of material to be distributed to position said chute means in flow communication with said supply of material, said chute means including a material receiving portion defining an inlet opening and a lower feed portion terminating in an outlet opening smaller than said inlet opening and being located above said downwardly moving portion of said operative run;

a swing ring interposed between said material receiving portion and said lower feed portion so that said lower feed portion is rotatable about a generally vertical axis relative to said material receiving portion, said conduit being affixed to said swing ring to rotate with said lower feed portion, thereby maintaining a fixed orientation between said outlet opening and said conveyor irrespective of the rotated position thereof relative to said material receiving portion; and power means for operatively powering the rotation of said conveyor and said rollers.

2. The material distributing mechanism of claim 1 further comprising a constraining member supported by said frame above the upwardly moving portion of said operative run of said conveyor, said constraining member forming an upper portion of said conduit and having a pair of laterally spaced legs positioned above lateral edges of said conveyor and a raised bight portion extending between said legs, said bight portion being positioned above a central part of said conveyor.

3. The material distributing mechanism of claim 2 wherein said chute means terminates in a constricted outlet opening positioned above a central part of said operative run of said conveyor, a lateral width of said constricted opening being smaller than a corresponding lateral width of said raised bight portion.

4. The material distributing mechanism of claim 2 wherein said constraining member is provided with a deflector panel pivotally connected thereto and being selectively movable between a lowered position in which material discharged off said conveyor at said discharge opening is engaged with said deflector panel and redirected downwardly therefrom and a raised position in which the deflector panel is not engageable with material discharged off said conveyor at said discharge opening.

5. The material distributing mechanism of claim 1 wherein said material receiving portion of said chute means is pivotally movable about a generally horizontally extending axis to effect a raising and lowering of said conduit.

6. The material distributing mechanism of claim 5 wherein said conduit is provided with a defector panel pivotally movable adjacent said discharge opening between a lowered position in which material discharged off said conveyor at said discharge opening is engaged with said deflector panel and redirected downwardly therefrom and a raised position in which the deflector panel is not engageable with material discharged off said conveyor at said discharge opening.

7. The material distributing mechanism of claim 1 wherein said defection means includes a pair of transversely spaced discs rotatably mounted on said frame above said conveyor and engageable with said operative run to cause a downward deflection thereof relative to a straight line extending between said rollers.

8. The material distributing mechanism of claim 7 wherein said chute means terminates in an outlet opening positioned above a central part of said operative run of said conveyor, said discs engaging lateral edges of the operative run of said conveyor and being laterally spaced a distance greater than a lateral width of said outlet opening, said outlet opening being operable to feed material onto the downwardly moving portion of said operative run between said discs.

9. The material distributing mechanism of claim 8 wherein said return run is engageable with an idler means for effecting a downward deflection of said return run to prevent interference with the operative run.

10. A material distributing mechanism mountable on a mobile vehicle carrying a supply of material dischargeable from said vehicle through a vehicle discharge opening in the rear of said vehicle, comprising:

chute means connectable to the rear portion of said vehicle to be extendable rearwardly therefrom and be in flow communication with said vehicle discharge opening to receive material therefrom, said chute means including an articulated material receiving portion defining an inlet opening and having a first member fixed to said vehicle and a second member pivotally connected to said first member for movement relative thereto about a generally horizontally extending pivot axis, said chute means further including a lower feed portion rotatably mounted to said second member for movement thereto about a generally vertically extending axis of rotation, said feed portion defining an outlet opening;

a longitudinally extending conduit rotatably mounted to said second member for rotational movement about said generally vertically extending axis with said lower feed portion, said conduit having laterally spaced side sheets terminating at a remote discharge opening;

an endless conveyor entrained around first and second longitudinally spaced rollers rotatably mounted between said side sheets, said conveyor having an upper operative run which normally moves toward said discharge opening and a lower return run normally moving away from said discharge opening;

deflection means operatively engaged with the operative run of said conveyor between said first and second rollers to cause a downward deflection of said conveyor relative to a straight line extending between said first and second rollers, said operative run being divided by said deflection means into a downwardly moving portion, an upwardly moving portion and a generally arcuate transition portion between said downwardly moving portion and said upwardly moving portion, said outlet opening of said feed portion feeding material onto said downwardly moving portion of said operative run; and power means for operatively powering the rotation of said conveyor and said rollers.

11. The material distributing mechanism of claim 10 wherein said feed portion and said conduit are connected to a swing ring carried by said second member of said material receiving portion to provide rotational movement thereof relative to said material receiving portion.

12. The material distributing mechanism of claim 11 wherein said defection means includes a pair of transversely spaced discs rotatably mounted on opposing said side sheets above said conveyor and being engageable with said operative run to cause said downward deflection thereof, said discs engaging lateral edges of the operative run of said conveyor and being laterally spaced a distance greater than a lateral width of said outlet opening, said outlet opening being operable to feed material onto the downwardly moving portion of said operative run between said discs.

13. The material distributing mechanism of claim 12 wherein said feed portion of said chute means has inwardly sloping sides to define an outlet opening smaller than said inlet opening.

14. The material distributing mechanism of claim 13 further comprising a constraining member supported by said side sheets above the upwardly moving portion of said operative run of said conveyor, said constraining member forming an upper portion of said conduit and having a pair of laterally spaced legs positioned above said lateral edges of said conveyor and a rised bight portion extending between said legs and being positioned above a central part of said conveyor.

15. The material distributing mechanism of claim 14 wherein said bight portion extends between said discs to a position corresponding to said arcuate transition, said legs terminating adjacent said discs.

16. The material distributing mechanism of claim 15 wherein said constraining member is provided with a deflector panel pivotally connected thereto and being selectively movable between a lowered position in which material discharged off said conveyor at said discharge opening is engaged with said deflector panel and redirected downwardly therefrom and a raised position in which the deflector panel is not engageable with material discharged off said conveyor at said discharge opening.

17. The material distributing mechanism of claim 16 wherein a linear actuator interconnects said second member of said material receiving portion with a fixed part of said vehicle to power the pivotal movement of said second member and said conduit about said pivot axis, said conduit being movable to a raised transport position in which said conduit is generally vertically oriented, said conduit being rotatable about said generally vertical axis of rotation to be positionable adjacent said vehicle when in said transport position.

18. The material distributing mechanism of claim 17 wherein said vehicle is a truck having a dump bed provided with a tailgate including a gated vehicle discharge opening, said first member of said material receiving portion is detachably connected to said tailgate in flow communication with said gated opening.

19. The material distributing mechanism of claim 18 wherein said power means is operable to rotate said conveyor at variable speeds to vary a velocity at which material is discharged off said conveyor from said conduit.

* * * * *